US005611526A

United States Patent [19]

Cornell

[11] Patent Number: 5,611,526

[45] Date of Patent: Mar. 18, 1997

[54] CUT SHEET TRAY HAVING A WEIGHTED PIVOTING JAM PREVENTION MEMBER

[75] Inventor: David J. Cornell, Holley, N.Y.

[73] Assignee: Eastman Kodak Company, Rochester, N.Y.

[21] Appl. No.: 595,059

[22] Filed: Feb. 1, 1996

[51] Int. Cl.[6] ..... B65H 5/22

[52] U.S. Cl. ..... 271/3.01; 271/225; 271/902

[58] Field of Search ..... 271/3.01, 3.03, 271/3.08, 3.09, 163, 184, 225, 902

[56] References Cited

U.S. PATENT DOCUMENTS

| | | | |
|---|---|---|---|
| 4,751,519 | 6/1988 | Shimada et al. | 346/76 |
| 4,849,786 | 7/1989 | Murakami | 355/311 |
| 4,887,133 | 12/1989 | Ikeda et al. | 271/902 X |
| 4,953,994 | 9/1990 | Shiozaki et al. | 400/120 |
| 5,093,690 | 3/1992 | Ohno et al. | 271/184 X |
| 5,327,206 | 7/1994 | Ueda et al. | 355/313 |

*Primary Examiner*—Boris Milef
*Attorney, Agent, or Firm*—Milton S. Sales

[57] ABSTRACT

The risk of jams that occur during return of a cut sheet to a position inside of a cut sheet tray as the trailing edge of the sheet moves past the leading edge of the stack of sheets remaining in the cut sheet tray is reduced by having the returning sheet itself move a lever to a position over the jam area when the cut sheet is returning to the tray. The lever has a first position covering the edge of the other cut sheets and a second position removed from the edge of the other cut sheets, whereby to not interfere with sheets being fed from the stack. An abutment surface on the member is located along the sheet path to move the member between said positions by the force of a cut sheet moving along the path.

4 Claims, 4 Drawing Sheets

CUT SHEET TRAY HAVING A WEIGHTED PIVOTING JAM PREVENTION MEMBER

CROSS-REFERENCE TO RELATED APPLICATION

Reference is made to commonly assigned, copending U.S. patent application Ser. No. 08/595,060 entitled JAM PREVENTION FOR CUT SHEET SUPPLY, filed in the name of T. Fisher concurrently herewith.

BACKGROUND OF THE INVENTION

1. Technical Field

This invention relates generally to an imaging apparatus wherein a plurality of cut sheets are stacked in a supply to be driven from the supply to be imaged, and more particularly to such apparatus wherein the sheets are at least partially returned to the supply during the imaging process.

2. Background Art

Copiers, printer, facsimile apparatus and similar imaging machines are often provided with a cut sheet tray from which sheets are fed, such as by a scuff roller. As used herein, the term "tray" shall include removable sheet holders and fixed bin sheet holders. The cut sheets may be used such as for originals to be reproduced or as receiver sheets to be imaged. In this specification and appended claims, the convention will be used that the sheets are stacked in the tray such that the "leading edge" of the sheets will be the first edge to emerge from the tray, and that the "trailing edge" of the sheets will be the last edge to emerge.

In a commercial thermal printer, the cut sheets travel downstream, leading edge first, from the tray to a printhead, where the sheets receive one of a plurality of color separation images. Before receiving each subsequent color separation image, the sheet is returned trailing edge first to a position upstream of the printhead. Because there is insufficient distance between the tray and the printhead for an entire sheet, the trailing edge of the sheet returns to a position inside of the cut sheet tray.

It has been found that, from time to time, jams may occur during the sheet-return process; particularly as the trailing edge of the sheet attempts to move past the leading edge of the stack of sheets remaining in the cut sheet tray.

DISCLOSURE OF THE INVENTION

It is an object of the present invention to reduce the risk of jams that occur during return of a cut sheet to a position inside of the cut sheet tray as the trailing edge of the sheet moves past the leading edge of the stack of sheets remaining in the cut sheet tray.

It is another object of the present invention to reduce the risk of jams that occur during return of a cut sheet to a position inside of the cut sheet tray by covering the jam area during the return of the cut sheet and uncovering the jam area during feeding of a cut sheet from the stack of sheets in the cut sheet tray.

It is still another object of the present invention to reduce the risk of jams that occur during return of a cut sheet to a position inside of the cut sheet tray by moving a lever to a position over the jam area when the cut sheet is returning to the tray.

It is yet another object of the present invention to reduce the risk of jams that occur during return of a cut sheet to a position inside of the cut sheet tray by having the returning sheet itself move a lever to a position over the jam area when the cut sheet is returning to the tray, and by having the cut sheet itself move the lever to a remote position during feeding of a cut sheet from the stack of sheets in the cut sheet tray.

According to a feature of the present invention, imaging apparatus, which has a sheet path and a supply for receiving a stacked plurality of cut sheets for feeding one at a time from the supply along the sheet path and which at least partially returns a cut sheet to the supply past an edge of any other cut sheets remaining in the supply, includes a member having a first position covering the edge of the other cut sheets and a second position removed from the edge of the other cut sheets, whereby to not interfere with sheets being fed from the stack. An abutment surface on the member is located along the sheet path to move the member between said positions by the force of a cut sheet moving along the path.

According to a preferred embodiment of the present invention, the abutment surface moves the member from its second position to its first position by the force of a cut sheet returning to the supply. The member is weighted to be gravity urged to one of the positions, preferably, its second position.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of a removable tray for image receiver sheets, it will be noted that the invention can be used with other types of devices for stacking a large plurality of cut sheets where a sheet that has been removed from the stack must be at least partially returned to the stack.

Figure 1:
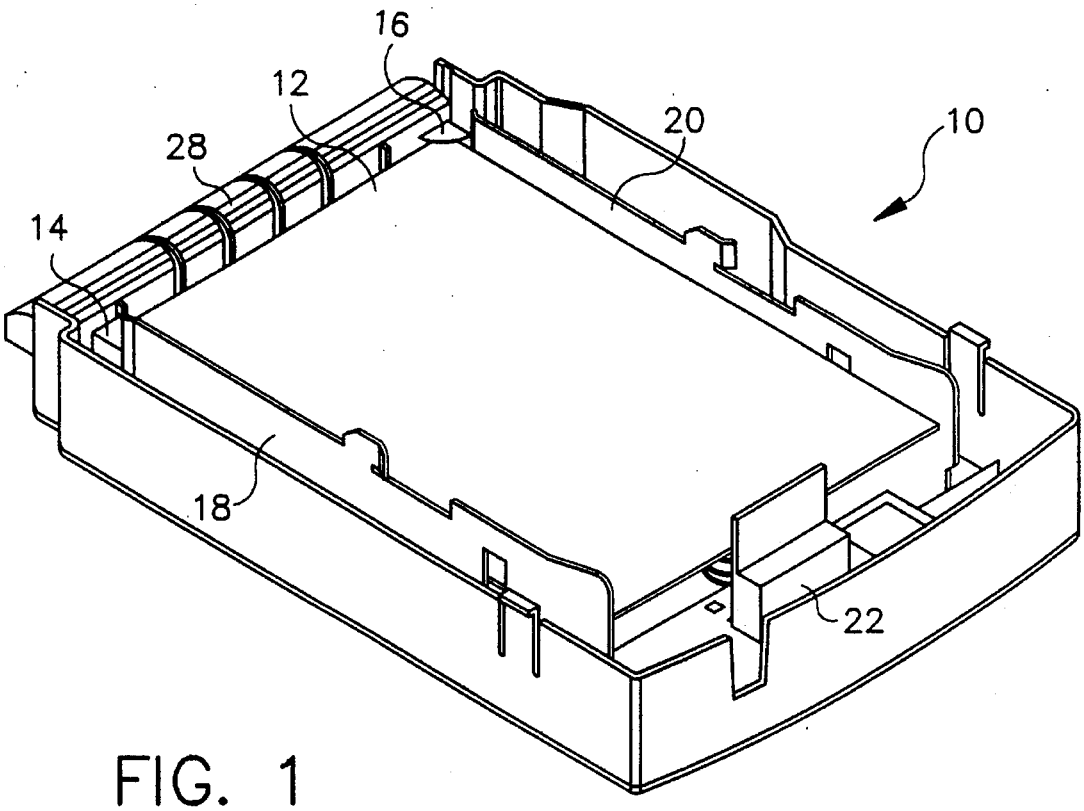
FIG. 1 (PRIOR ART)
FIG. 1 is a perspective assembly view of a cut sheet supply tray according to the prior art.

Referring to FIG. 1, a tray 10 having an open top is adapted to receive a stack of cut sheets 12 for supply one at a time to a machine, such as for example an imaging apparatus. The sheets may be original documents to be reproduced or blank sheets upon which an image is to be received. The leading edges of the sheets of the stack are located against corner abutments 14 and 16. The side edges of the sheets of the stack are aligned by a fixed edge guide 18 and a laterally-adjustable edge guide 20, while the rear edge of the sheets of the stack are positioned by a movable rear guide 22.

Figure 2:
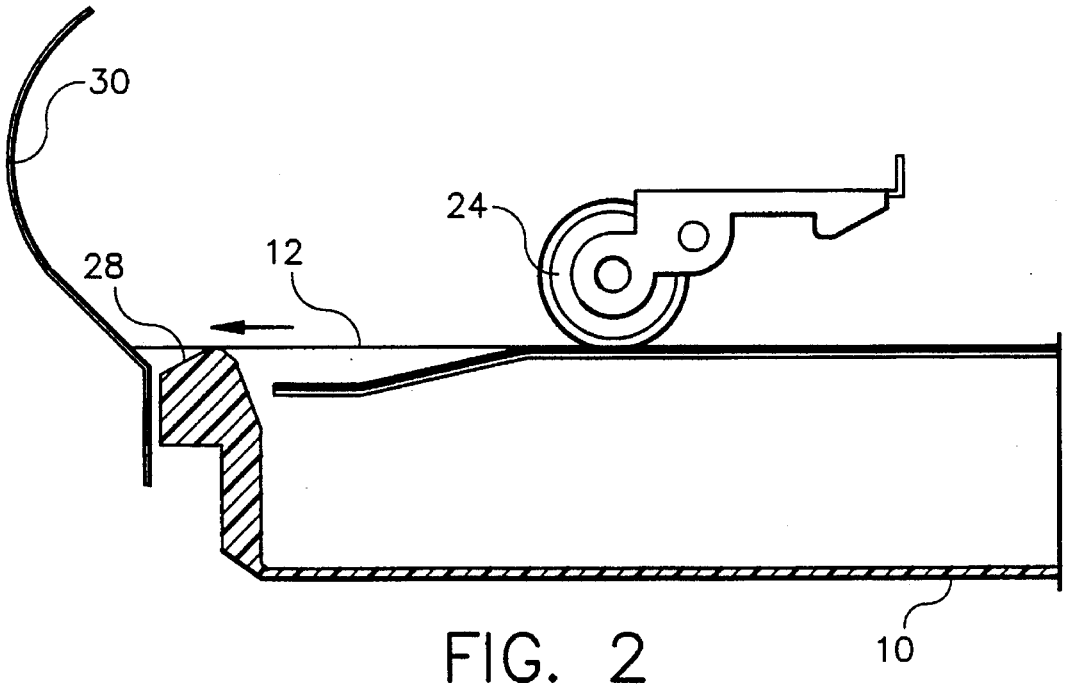
FIG. 2 (PRIOR ART)
FIG. 2 is a view of the cut sheet supply tray of FIG. 1 showing a sheet being fed from the stack.
Figure 3:
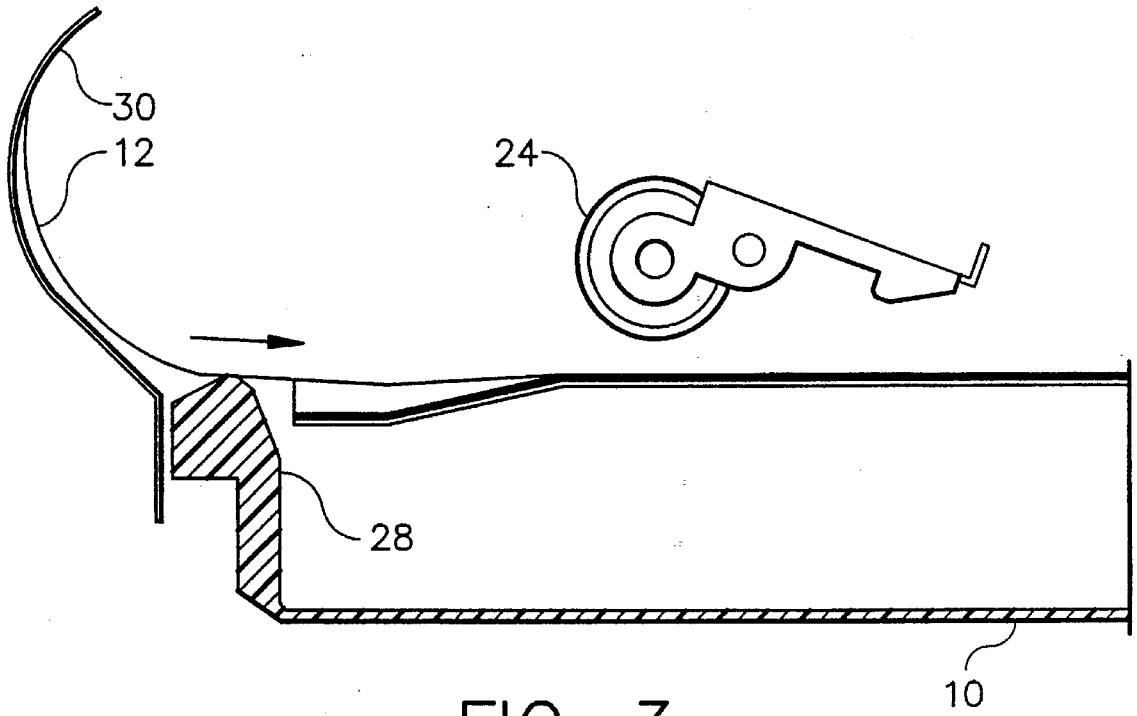
FIG. 3 (PRIOR ART)
FIG. 3 is a view of the cut sheet supply tray of FIG. 1 and associated imaging apparatus, showing a sheet being attempted to be returned to the stack.

FIG. 2 shows a sheet 12 being fed from the stack by a picker roller 24. The leading edge of the sheet rides over a front tray surface 28 to a sheet guide 30. Sheet guide 30 directs sheet 12 to a printhead, not shown. After the sheet has been imaged with one of a plurality of color separations, it is returned to the upstream side of the printhead. During this return process, the trailing edge of the sheet must enter tray 10. As can be seen in FIG. 3, there is a risk that the edge of the sheet may engage the edge of the stack of sheets remaining in the tray; causing a jam condition.

Figure 5:
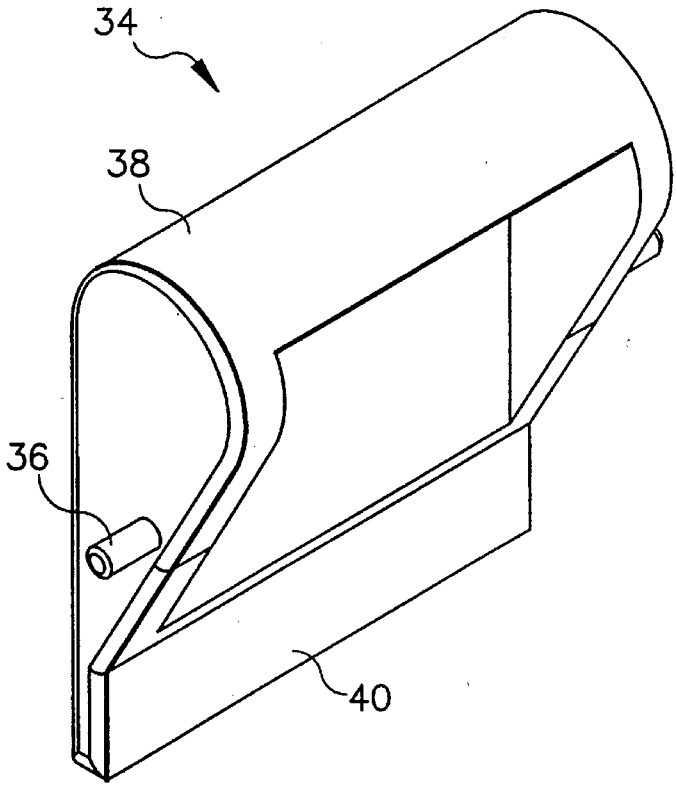
FIG. 5 is a perspective view of a detail of the cut sheet supply tray of FIG. 4.
Figure 4:
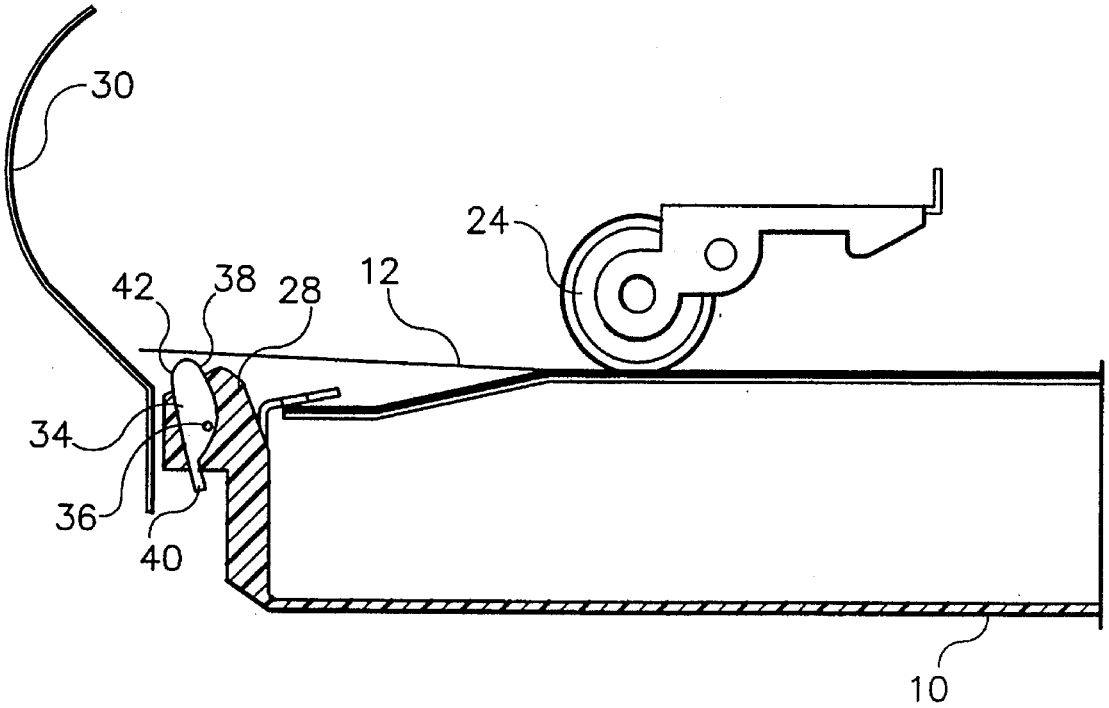
FIG. 4 is a side sectional view of a cut sheet supply tray and associated imaging apparatus according to the present invention.
Figure 6:
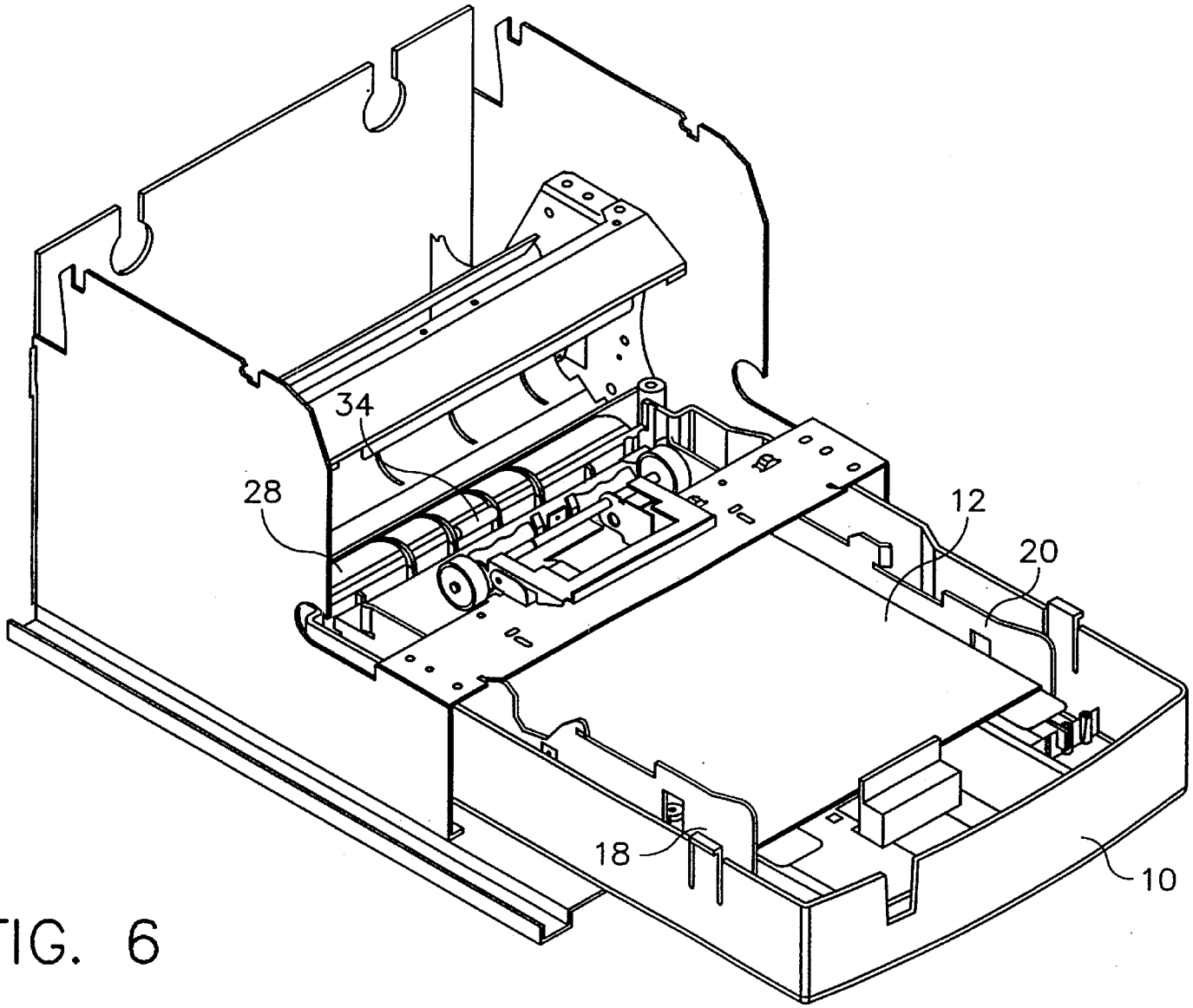
FIG. 6 is a perspective assembly view of the cut sheet tray and imaging apparatus of FIG. 4.

FIG. 4 shows a lever 34 mounted in tray 10 at pivot point 36. As best seen in FIG. 5, lever 34 has a rounded guide surface 38 and a weighted extension 40. Referring to FIG. 6, lever 34 extends through a hole in the front tray surface 28. Weighted extension 40 biases the lever to a position shown in FIG. 4, whereat rounded guide surface 38 provides a path for the leading edge of a cut sheet to move past the lever to the sheet path of the imaging apparatus.

Figure 7:
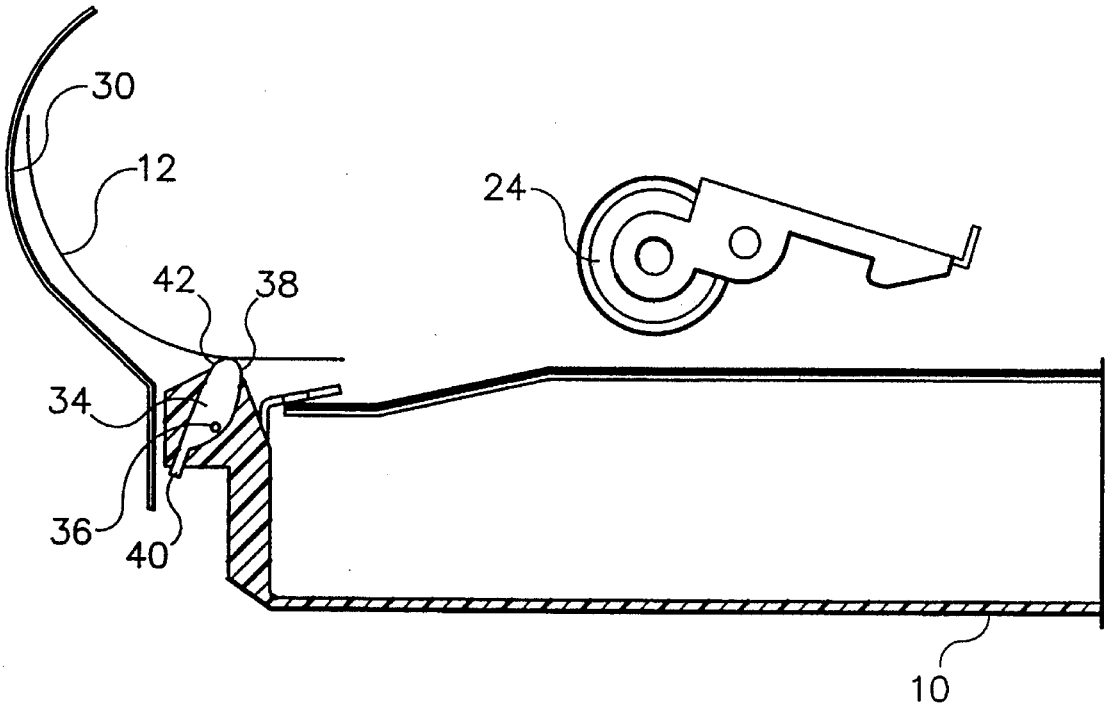
FIG. 7 is a side schematic view of the cut sheet tray and imaging apparatus of FIG. 4 showing the cut sheet supply tray and the imaging apparatus in a second operational state.

Referring to FIGS. 7, the edge of a cut sheet returning to tray 10 first engages an abutment surface 42 on the leading edge of rounded guide surface 38, rocking lever 34 about its pivot point 36. Lever 34 now covers the leading edge of the stack of sheets 12 remaining in the tray, preventing a jam condition as a sheet 12 re-enters the tray.

The invention has been described in detail with particular reference to preferred embodiments thereof, but it will be understood that variations and modifications can be effected within the spirit and scope of the invention.

What is claimed is:

1. Imaging apparatus having a sheet path and a supply for receiving a stacked plurality of cut sheets for feeding, one at a time from the supply along the sheet path; said imaging apparatus comprising:

means for at least partially returning a cut sheet to the supply past an edge of any other cut sheets remaining in the supply;

a member having a first position covering the edge of said any other cut sheets and a second position removed from the edge of said any other cut sheets, whereby to not interfere with sheets being fed from the stack; and an abutment surface located on the member such that a force applied to the abutment surface is operative to move the member between said positions, the abutment surface being located along the sheet path whereby the member is moved between said positions by the force of a cut sheet moving along the path.

2. Imaging apparatus as set forth in claim 1, wherein the force applied to said abutment surface moves the member from its second position to its first position and is the force from a cut sheet returning to the supply.

3. Imaging apparatus as set forth in claim 1, wherein the member is weighted to be gravity urged to one of the positions.

4. Imaging apparatus as set forth in claim 3, wherein the member is weighted to be gravity urged to its second position.

* * * * *